US005569404A

United States Patent [19]

Francisco et al.

[11] Patent Number: 5,569,404

[45] Date of Patent: Oct. 29, 1996

[54] OIL SOLUBLE IODIDES AS LUBRICANT ANTIOXIDANTS

[75] Inventors: Manuel A. Francisco, Washington; Kenneth D. Rose, Clinton, both of N.J.

[73] Assignee: Exxon Research and Engineering Company, Florham Park, N.J.

[21] Appl. No.: 390,728

[22] Filed: Feb. 17, 1995

[51] Int. Cl.[6] ..... C10M 125/18

[52] U.S. Cl. ..... 508/547; 508/167

[58] Field of Search ..... 252/25, 58

[56] References Cited

U.S. PATENT DOCUMENTS

| | | | |
|---|---|---|---|
| 3,066,098 | 11/1962 | Nichols | 252/25 |
| 3,256,186 | 6/1966 | Greenwald | 252/25 |
| 3,499,839 | 3/1970 | Boehm | 252/58 |
| 3,769,210 | 10/1973 | Cais et al. | 252/25 |
| 3,865,743 | 2/1975 | Sheratte | 252/58 |
| 4,148,739 | 4/1979 | Liston et al. | 252/58 |
| 4,156,655 | 5/1979 | Clarke et al. | 252/25 |
| 4,426,342 | 1/1984 | Dria et al. | 252/58 |

FOREIGN PATENT DOCUMENTS

| | | | |
|---|---|---|---|
| 51-29522 | 8/1976 | Japan | C10M 125/18 |
| 63-161076 | 7/1988 | Japan | C10M 125/18 |
| 1342917 | 10/1987 | U.S.S.R. | C10M 125/18 |

OTHER PUBLICATIONS

Smalheer et al, "Lubricant Additives", Section I–Chemistry of Additives, pp. 1–11, 1967.

*Primary Examiner*—Ellen M. McAvoy
*Attorney, Agent, or Firm*—Linda M. Scuorzo

[57] ABSTRACT

The present invention provides for the use of certain oil soluble iodides to enhance the oxidation resistance of lubricating oils and fuels, and for the novel formulated compositions containing these iodides. Oil soluble iodides such as $C_{16}$ to $C_{78}$ alkyl ammonium as well as oil solubilizable or dispersible iodides such as $CoI_2$, CuI, KI and NaI in combination with a suitable dispersing agent may be used. Typically a minor amount of additive, from about 40 to about 1000 ppm is used. The additive is effective as an antioxidant in a variety of different types of base and formulated oils.

4 Claims, 3 Drawing Sheets

OIL SOLUBLE IODIDES AS LUBRICANT ANTIOXIDANTS

FIELD OF THE INVENTION

The present invention relates to certain iodides as lube oil antioxidants.

BACKGROUND OF THE INVENTION

There is a continuing need for new additives that address the problem of oxidative degradation of lubricants in internal combustion engines. Antioxidants having the ability to neutralize or minimize oil degradation chemistry, particularly hydroperoxide radical chemistry are needed. The present invention addresses these needs.

SUMMARY OF THE INVENTION

Figure 1:
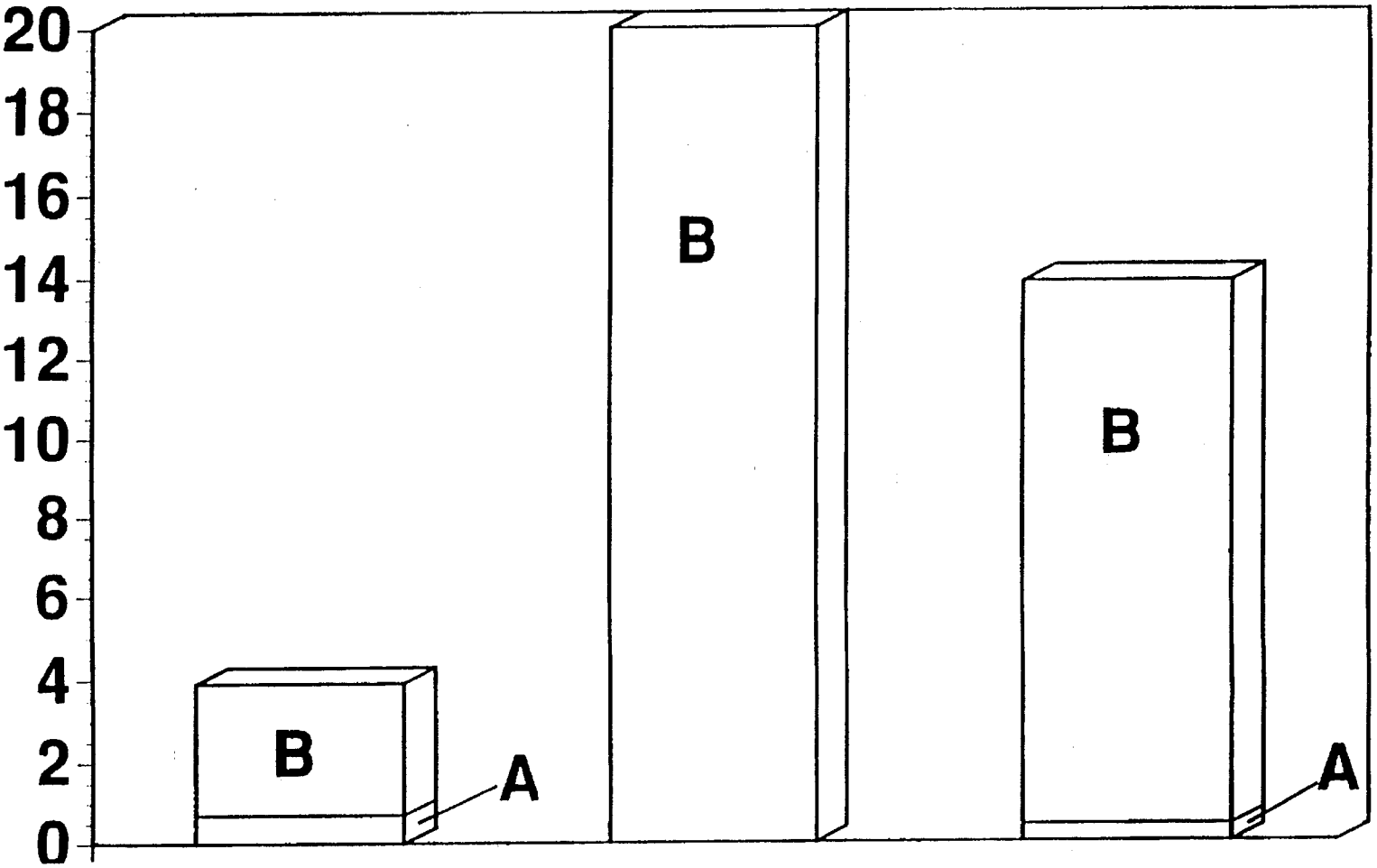
FIG. 1 shows the performance of oil the soluble iodides, tertiary butyl ammonium iodide (bar 2), $C_{37}H_{78}NI$ (bar 3) in hexadecane based on mmoles of cumene hydroperoxide ("CHP") decomposed per wt % additive in hexadecane in comparison to commercial copper PIBSA antioxidant in hexadecane (bar 1).

The present invention provides for lubricating oil compositions, comprising a major amount of a lubricating oil and a compound or species capable of generating oil soluble iodide ions in the oil in a minor amount effective to enhance the antioxidancy of the lubricating oil. Preferably the oil soluble iodide is present in an amount of from about 40 to about 1000 ppm. The invention has utility in applications in which enhanced antioxidancy is desired.

The present invention may suitably comprise, consist or consist essentially of the elements disclosed herein, and may be practiced in the absence of an element not specifically recited.

DETAILED DESCRIPTION OF THE INVENTION

The present invention provides for a method of imparting enhanced antioxidancy properties to lubricating oils by combining a hydrocarbon, preferably oil, soluble iodide in an amount that is sufficient or effective to impart antioxidancy properties, with an oil, preferably a lubricating oil (i.e. a base or formulated oil) to enhance the antioxidant properties of the oil.

The present invention also provides for formulated oil compositions containing a lubricating oil, and an antioxidancy enhancing amount of an hydrocarbon, preferably oil soluble iodide.

The iodides that are used in accordance with the present invention are soluble in hydrocarbons, preferably oils of lubricating viscosity. As used herein the term "soluble"

iodide means that the iodides are soluble, solubilizable or otherwise stably dispersible in hydrocarbons, preferably oils, that are liquid at temperatures found in the environments at which lubricating oils are typically used. The term "stably dispersible" means that the iodide is capable of being dispersed to an extent that allows it to function in its intended manner. Thus, for example an iodide is oil soluble if it is capable of being dispersed or suspended in, for example, a lubricating oil in a manner sufficient to allow the oil to function as a lubricant. Suitably any iodide that is or can be rendered hydrocarbon or oil sol ubl e may be used.

Most typically the iodides are soluble iodide salts, however, non-salt iodides that meet the sol ubil ity requirements previously discussed may also be suitable. Thus, generally any hydrocarbon, preferably oil, soluble iodide that is capable of generating iodide ions at process condition may be used.

Thus, one embodiment includes iodides that are themselves soluble in the hydro-carbon or oil and the formulated oil compositions containing them. These iodides are typically organic iodides (i.e. iodides having an organic counterion), such as soluble $C_{16}$ to $C_{78}$ iodides preferably alkyl ammonium iodides. Specific examples of organic iodides include preferably tertiary butyl ammonium iodides, tridodecyl-methyl ammonium iodides and hexadecyl ammonium iodides ($C_{16}H_{36}HNI$).

Another embodiment includes iodides that are hydrocarbon or oil soluble at the conditions described with the aid of solubilizing, complexing or other dispersing agents (i.e. solubilizable or stably dispersible). These typically include inorganic iodides (i.e. iodides having a metal counterion), such as alkali metal salts of iodides or transition metal salts of iodides. Specific examples include $CoI_2$, CuI, KI, and NaI.

Given the environment in which the iodides will be present it is extremely desirable that the iodide have a molecular weight sufficient not only to remain soluble but also to not vaporize or volatilize at engine operating conditions and also remain soluble at lower, particularly cold temperatures.

Solubilizing and dispersing agents, are known in the art and include surfactants, detergents, complexing agents and the like, for example overbased and neutral detergents, such as calcium sulfonate. The iodides and surfactants, detergents and complexing agents may be obtained from commercial sources or synthesized using known procedures. Surfactant complexing or dispersing agents are typically added in amounts known in the art. The antioxidant may be added to produce the formulated oil by any of the methods known to the oil.

Generally, the formulated oil compositions of the present invention comprise a major amount of a base or formulated oil of lubricating viscosity and a minor amount of the hydrocarbon or oil soluble iodide or mixture of iodides. The term "minor amount" means an amount of less than 50% by weight of the composition. The term "major amount" means an amount of more than 50% by weight of the composition. The minor amount of the iodide to the base or formulated oil in this invention should be sufficient to retard oxidation of the hydrocarbon (e.g., base or formulated oil) to which it is added and typically is such that the treated lubricant compositions have the iodide present in a minor amount of from about 40 ppm to 1000 ppm, preferably 40 ppm to 500 ppm, and most preferably 40 ppm to 100 ppm by weight of the composition. For example, typically this can be accomplished using amounts of as low as 40 ppm for $CoI_2$, but will vary depending on the iodide and the counterion (cation) and the degree of solubility. On a weight percent basis the antioxidant may be added to produce the formulated oil by any of the methods known to the oil.

The oil of lubricating viscosity which is utilized in the preparation of the lubricants for use in the invention may be based on natural oils, synthetic oils, or mixtures thereof. Natural oils include animal oils and vegetable oils as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include refined hydrocarbon oils and halosubstituted hydrocarbon oils such as polymerized and interpolymerized olefins poly(1-hexenes), poly(1-octenes), poly(1-decenes), etc. and mixtures thereof; alkylbenzenes; polyphenyls alkylated diphenyl ethers and alkylated diphenyl sulfides and the derivatives, analogs and homologs thereof and the like. Unrefined, refined and rerefined oils, either natural or synthetic (as well as mixtures of two or more of any of these) of the type disclosed hereinabove can be used in the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps known in the art. Rerefined (i.e., reclaimed or reprocessed) oils are obtained by processes similar to those used to obtain refined oils applied to refined oils, but often are additionally processed by techniques directed to removal of spent additives and oil breakdown products. Most preferably, the oil used herein is a petroleum derived oil.

The lubricant oil is typically utilized in the invention at 75% to 99.5% by weight of the composition, preferably about 80% to about 99% by weight. The diluent oils (lubricants) present as various additives are included in the above amounts.

The present invention also contemplates the use of other additives in the compositions. These other additives include such conventional additive types as viscosity modifies extreme pressure agents, corrosion-inhibiting agents, pour point depressants, color stabilizing agents, anti-foam agents, and other such additive materials known generally to those skilled in the art of formulating lubricants.

The present invention is exemplified by reference to the following examples:

GENERAL

The effect of the iodide additives of the present invention in inhibiting the degradation of oils was evaluated by determining the ability of the iodide additives to catalyze the decomposition of hydroperoxides to prevent lubricant degradation (i.e. without forming radicals that oxidize the oil). The effects of the additives of the present invention on decomposing cumene hydroperoxide ("CHP") under test conditions (100° C., 1 hour excess of CHP) were evaluated. The moles of CHP decomposed per unit (mole or wt %) of additive represent the "turnover number" and are given in each histogram (bar) for "radical", (identified in the Figures as A) "combined radical and non-radical" (identified in the Figures as B) and "non-radical" products (identified in the Figures as C).

FIG. 1 shows the effect in hexadecane on a mmoles CHP decomposed/wt % additive basis of tertiary butyl alkyl ammonium iodide ("TBAI") and $C_{37}H_{78}NI$ as iodide additives according to the present invention in comparison to a commercially available copper PIBSA antioxidant in hexadecane. The iodide additives are more potent antioxidants than Copper PIBSA because they decompose more CHP by nonradical/radical mechanism per wt % additive.

Figure 2:
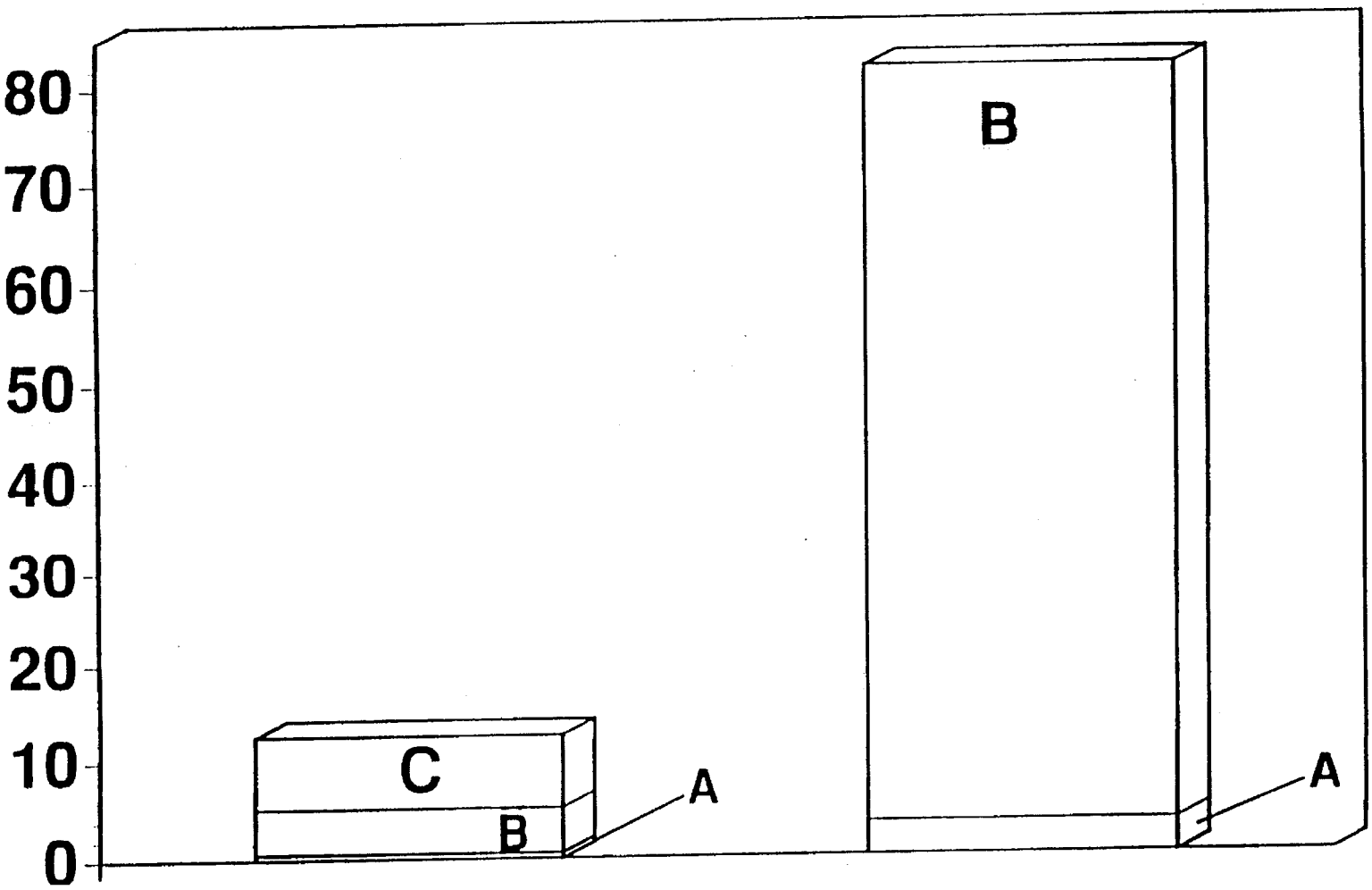
FIG. 2 shows the performance of the oil soluble iodide, tertiary butyl ammonium iodide (bar 2), as an antioxidant in fully a formulated oil in comparison to the commercial formulation without the iodide (bar 1), based on moles of CHP decomposed per mole of additive.

FIG. 2 shows the effect on a mole CHP decomposed/mole additive basis in a commercially formulated oil with TBAI in comparison to the commercially formulated oil (a 10W-30 passenger car motor oil) without iodide additive.

Figure 3:
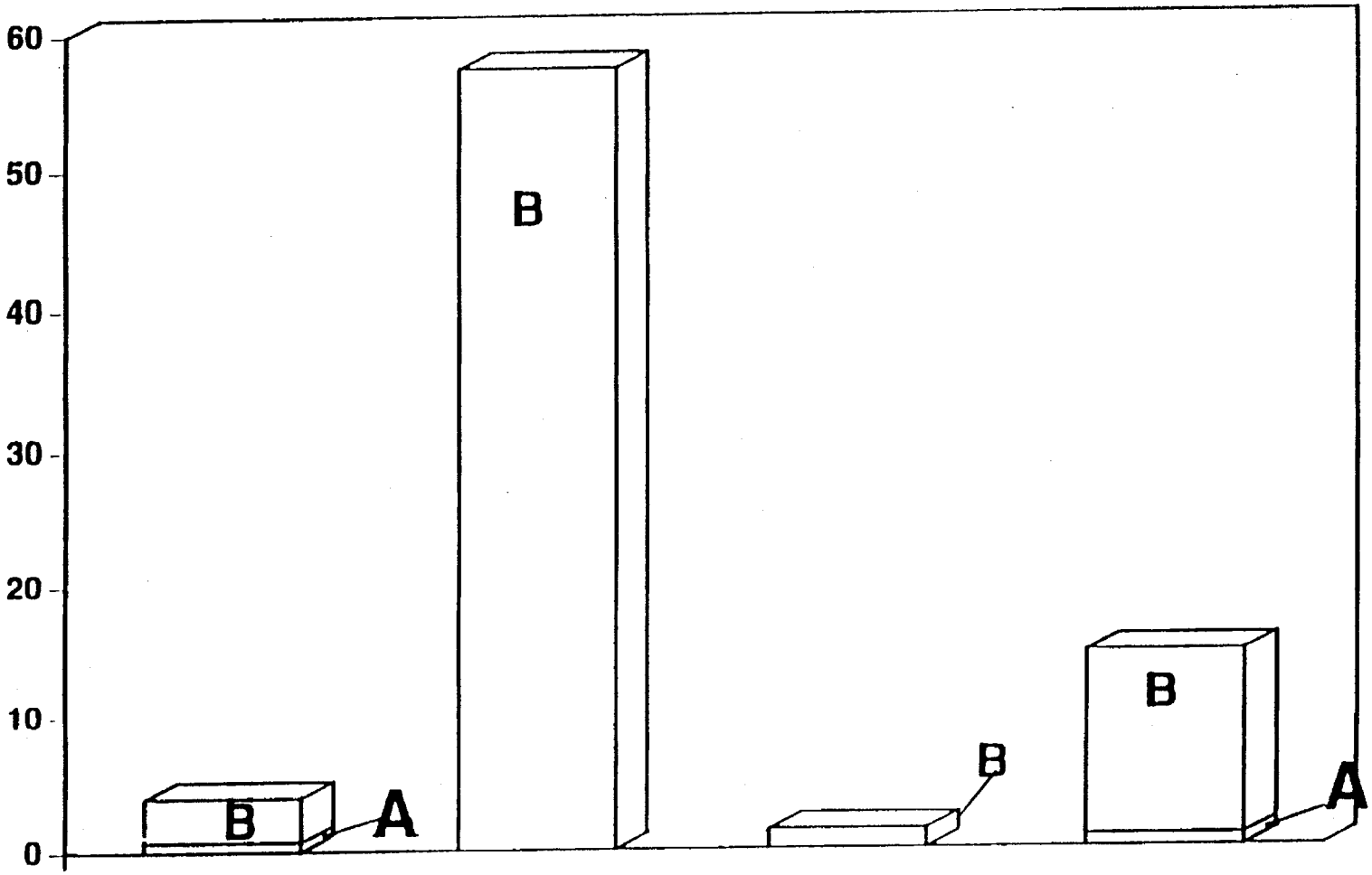
FIG. 3 shows the performance of the inorganic iodide, $CoI_2$, dispersed using calcium sulfonate in (S150N/S100N) base stock and in the model base stock, hexadecane, in comparison to a commercially available copper PIBSA antioxidant.

FIG. 3 shows the effect on a mole CHP decomposed/wt % additive basis of the inorganic iodide, $CoI_2$, in combination with calcium sulfonate surfactant in hexadecane (bar 2) and in a S100N/S100N oil (bar 4) in comparison to copper PIBSA in hexadocane (bar 1) the S100N/S100N oil (bar 3).

In each Figure the total height (y-axis) of each bar represents the total number of moles of CHP decomposed per unit of each additive (moles or wt %). The relatively greater height of the bar graphs corresponding to the iodide additives of the present invention demonstrates the enhanced performance of the iodide additives of the present invention as cumene hydroperoxide decomposers.

In the Figures TBAI was added at 0.07 wt %, $C_{37}H_{78}NI$ at 0.16 wt % and copper PIBSA at 0.07 wt %.

What is claimed is:

1. A lubricating oil composition, comprising: a major mount of an oil of lubricating viscosity and a minor mount of an organic iodide salt capable of generating oil soluble iodide ions in the oil effective to enhance the antioxidancy of the lubricating oil.

2. The composition of claim 1 wherein the iodide is a $C_{16}$ to $C_{78}$ alkyl ammonium iodide.

3. The composition of claim 1 wherein the iodide is present in an amount of from about 10 to about 1000 ppm.

4. A method of enhancing the antioxidancy of a lubricating oil, comprising: combining a major amount of an oil of lubricating viscosity and an organic iodide s.alt capable of generating oil soluble iodide ions in the oil in a minor amount effective to enhance the antioxidancy of the oil.

* * * * *